US008113172B2

(12) United States Patent
Farrell

(10) Patent No.: US 8,113,172 B2
(45) Date of Patent: Feb. 14, 2012

(54) ADJUSTABLE ADVANCE DISTRIBUTOR

(76) Inventor: Kenneth William Farrell, Corona, CA (US)

( * ) Notice: Subject to any disclaimer, the term of this patent is extended or adjusted under 35 U.S.C. 154(b) by 210 days.

(21) Appl. No.: 12/563,963

(22) Filed: Sep. 21, 2009

(65) Prior Publication Data

US 2010/0206255 A1 Aug. 19, 2010

Related U.S. Application Data

(60) Provisional application No. 61/099,164, filed on Sep. 22, 2008.

(51) Int. Cl.
*F02P 7/02* (2006.01)
*F02P 5/05* (2006.01)
*F02P 5/145* (2006.01)

(52) U.S. Cl. ..... 123/406.11; 123/406.12; 123/406.58; 123/595; 123/146.5 A

(58) Field of Classification Search ..... 123/146.5 A, 123/406.11, 406.12, 406.58, 406.67, 595, 123/609
See application file for complete search history.

(56) References Cited

U.S. PATENT DOCUMENTS 1,641,442 A * 9/1927 Kroeger ..... 200/19.39
2,394,792 A * 2/1946 MacMillan ..... 123/406.11
2,640,891 A * 6/1953 Buck et al. ..... 200/19.22
2,820,858 A * 1/1958 Tompkins ..... 200/19.22
2,835,755 A * 5/1958 Filko ..... 200/19.27
2,944,122 A * 7/1960 Thedick ..... 200/19.21
3,242,274 A * 3/1966 Sanden ..... 200/19.22
3,350,517 A * 10/1967 Soeters ..... 200/19.22
3,510,609 A * 5/1970 Cooksey ..... 200/19.3
3,581,025 A * 5/1971 Yeo et al. ..... 200/19.3
3,660,623 A * 5/1972 Bevacqua ..... 123/146.5 A
3,817,234 A * 6/1974 Jirousek ..... 123/406.75
3,974,817 A * 8/1976 Henderson et al. ..... 123/149 D
3,988,552 A * 10/1976 Faben ..... 200/19.22
4,058,691 A * 11/1977 Wittner ..... 200/19.21
4,111,168 A * 9/1978 Ehrmann et al. ..... 123/406.67
5,701,875 A * 12/1997 Judd ..... 123/595
2005/0039731 A1 * 2/2005 Bittner ..... 123/595

* cited by examiner

*Primary Examiner* — Erick Solis
(74) *Attorney, Agent, or Firm* — Knobbe, Martens, Olson and Bear, LLP

(57) ABSTRACT

A distributor is configured with an outer housing that has a first portion and a second portion. The first portion and the second portion are adjustable in angular orientation relative to each other. Movement of the second portion relative to the first portion changes ignition timing in the distributor. The movement can be caused by rotation of a thumbwheel such that ignition timing can be changed without mechanical tools. The first and second portions also can comprise visual or tactile markings such that ignition timing can be changed without a timing light. The outer housing can be used in multiple applications simply by changing a length of a shaft housing member that houses a distributor shaft and a gear that is mounted to the distributor shaft.

18 Claims, 5 Drawing Sheets

ADJUSTABLE ADVANCE DISTRIBUTOR

CROSS-REFERENCE TO RELATED APPLICATIONS

This application is a non-provisional of U.S. Provisional Patent Application No. 61/099,164, which was filed on Sep. 22, 2008, claims priority to that application under 35 U.S.C. §119(e) and incorporates by reference that application in its entirety.

BACKGROUND OF THE INVENTION

1. Field of the Invention

The present invention generally relates to distributors used to control ignition timing in motor vehicles. More particularly, the present invention relates to modular and adjustable distributor assemblies used to control ignition timing in motor vehicles.

2. Description of the Related Art

Conventionally, ignition timing in an engine is adjusted by loosening a clamp nut of a distributor. Once the distributor clamp nut is loosened, the distributor housing can be rotated until an appropriate timing mark was properly located relative to the timing pointer on the engine. Once the distributor housing was properly oriented, the clamp nut would be tightened. Conventional timing adjustment could take considerable time because the distributor often moved in an unpredictable manner during tightening of the clamp nut.

In addition, distributors of varying makes and models of engines often differ one from the next. Thus, a distributor manufacturer often had to produce several varieties of distributors to meet consumer demand.

SUMMARY OF THE INVENTION

For these reasons, a modular and adjustable distributor assembly is desired. The distributor preferably allows a user to quickly and easily adjust the timing of the vehicle. In some configurations, the adjustable advance distributor can be adjusted without the use of mechanical tools of any type. In such embodiments, the timing can be adjusted through finger-adjustable control members. An upper housing of the distributor can be split into two separate components that are connected together by an adjustable mechanism. The adjustable mechanism allows the ignition advance to be adjusted by turning a knob. The knob forms a portion of an adjustment mechanism that connects the two separate components together. Thus, because the knob can be easily turned while the engine is running, the adjustable advance distributor can be used to make changes to the ignition timing without the use of a timing light or the like. Preferably, the housing comprises scaled degree markings for easy viewing of changes, which provides an added level of adjustment control to the user.

In some configurations, the adjustable advance distributor comprises a modular construction that allows a manufacturer to mass produce an upper adjustable portion of the distributor while facilitating an interchange of shafts to fit various engines with minimal tooling expense.

BRIEF DESCRIPTION OF THE DRAWINGS

These and other features, aspects and advantages of the present invention will now be described with reference to the drawings of a preferred embodiment, which embodiment is intended to illustrate and not to limit the invention, and in which figures.

DETAILED DESCRIPTION OF THE PREFERRED EMBODIMENT

Figure 1:
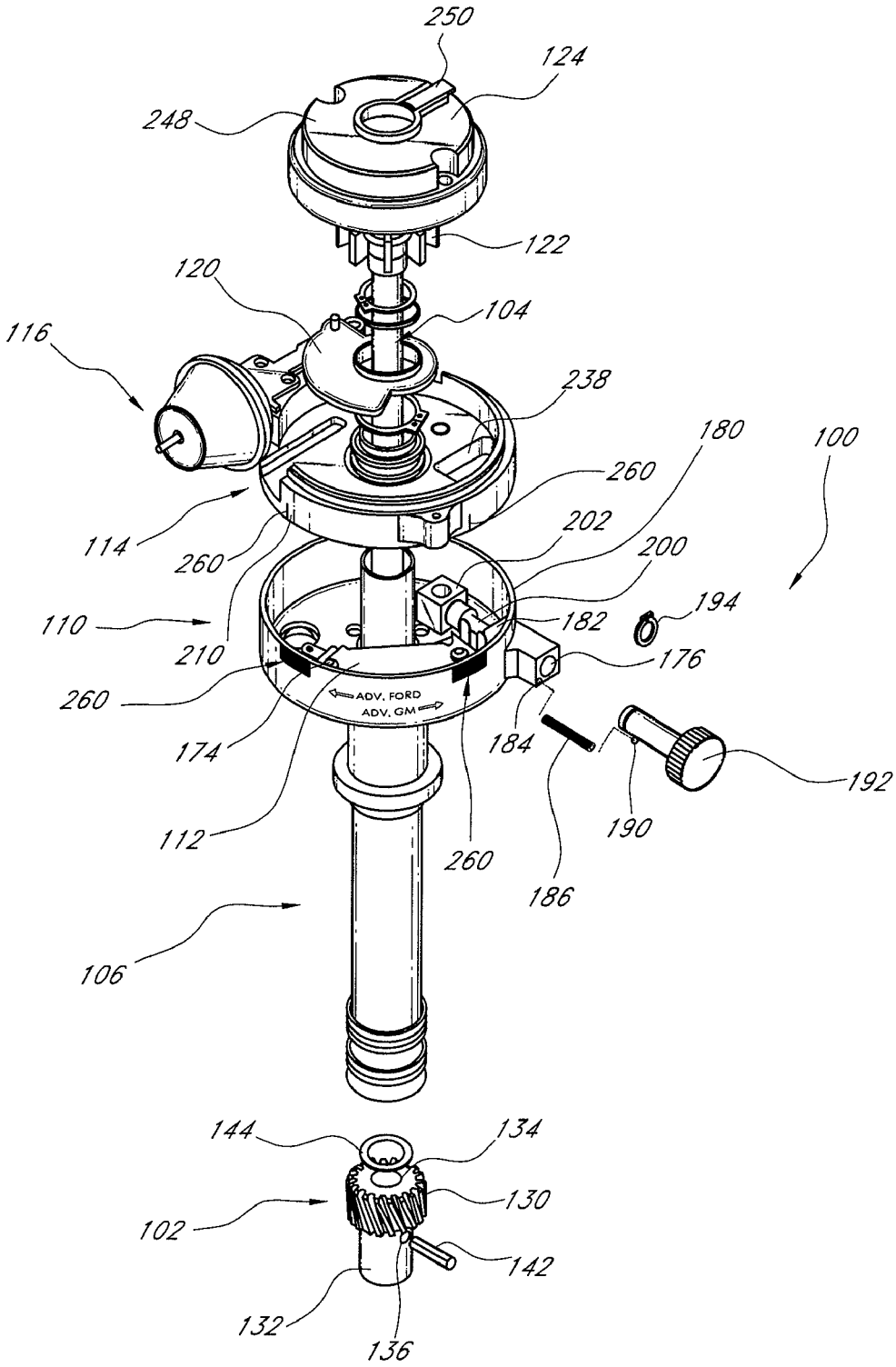
FIG. 1 is an exploded perspective view of an adjustable advance, modular distributor that is arranged and configured in accordance with certain features, aspects and advantages of the present invention.

An adjustable advance distributor 100 is shown in FIG. 1. The distributor 100 generally comprises a drive gear 102. The drive gear 102 is connected to a distributor shaft 104. The distributor shaft 104 can be a hardened steel shaft having a diameter of about 0.50 inch. The distributor shaft 104 extends upward from the drive gear 102 through a shaft housing assembly 106. The shaft housing 106 connects to a lower housing assembly 110 that contains an ignition module 112 in the illustrated configuration. The lower housing assembly 110 can comprise an anodized lower housing assembly 110. A top plate assembly 114 overlies the lower housing assembly 110. The top plate assembly 114 contains at least a portion of a vacuum advance assembly 116 that connects to a cam plate 120. A timing wheel or reluctor 122 connects to the distributor shaft 104 and the distributor shaft 104 connects to a rotor assembly 124.

Figure 2:
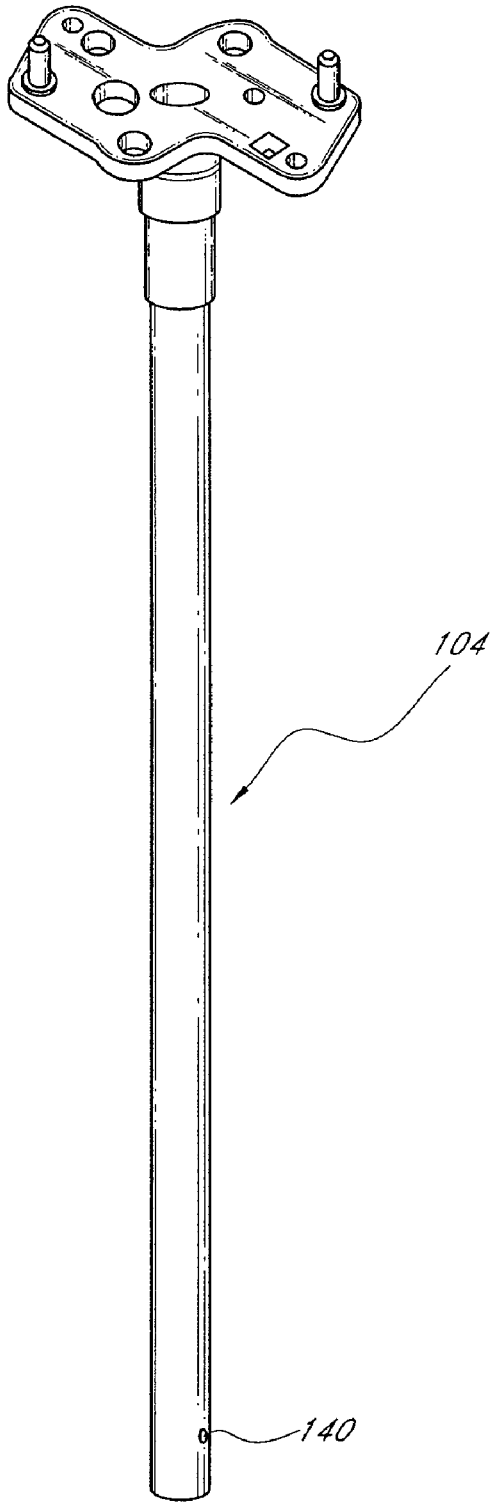
FIG. 2 is a perspective view of a distributor shaft of the distributor of FIG. 1.

With reference to FIG. 1, the drive gear 102 comprises a spiral or helical cut gear portion 130 and a lower generally cylindrical portion 132. The illustrated drive gear 102 also comprises an axially extending bore 134 and a radially extending hole 136. The axially extending bore 134 receives an end portion of the distributor shaft 104. The end portion of the distributor shaft comprises a second radially extending hole 140 (see FIG. 2). The second radially extending hole 140 generally aligns with the radially extending hole 136 of the drive gear. A roll pin 142 can be positioned in the radially extending hole 136 and the second radially extending hole 140. Thus, the roll pin 142 secures the drive gear 102 onto an end portion of the distributor shaft 104. Preferably, a thrust washer 144 is positioned along a top surface of the drive gear 102 and the distributor shaft 104 extends through the thrust washer 144.

The drive gear 102 can be interchanged such that the distributor 100 can be modified depending upon the make and model of engine that the distributor will be used with. For example, General Motors and Ford use different drive gears to transfer movement to the stock distributors. The drive gear 102 can be selected to correspond to the stock drive gear pattern. In addition, in some configurations, the distributor shaft 104 can be varying lengths such that the length can be changed depending upon the application. This modular configuration enhances the number of makes and models of engines with which the distributor 100 can be used.

The lower end of the shaft housing assembly 106 may comprise a recess that accommodates a sleeve bearing 146 while an upper end of the shaft housing assembly 106 may comprise a recess that accommodates a ball bearing 150. The ball bearing 150 can be a sealed roller bearing in some embodiments. The sleeve bearing 146 can be a bronze bushing in some embodiments. In some configurations, the sleeve bearing 146 and the ball bearing 150 are simply press fit into the shaft housing assembly 106. Together, the sleeve bearing 146 and the ball bearing 150 journal the distributor shaft 104 within the shaft housing assembly 106.

In the illustrated embodiment, the shaft housing assembly 106 also comprises a smaller diameter hole 152 and a larger diameter hole 154. Both of the smaller diameter hole 152 and the larger diameter hole 154 extend part way through the shaft housing assembly 106. In the illustrated configuration, both of the holes 152, 154 extend into a central bore that contains the distributor shaft 104. In the illustrated embodiment, the two holes 152, 154 are positioned between the sleeve bearing 146 and the ball bearing 150.

Figure 3:
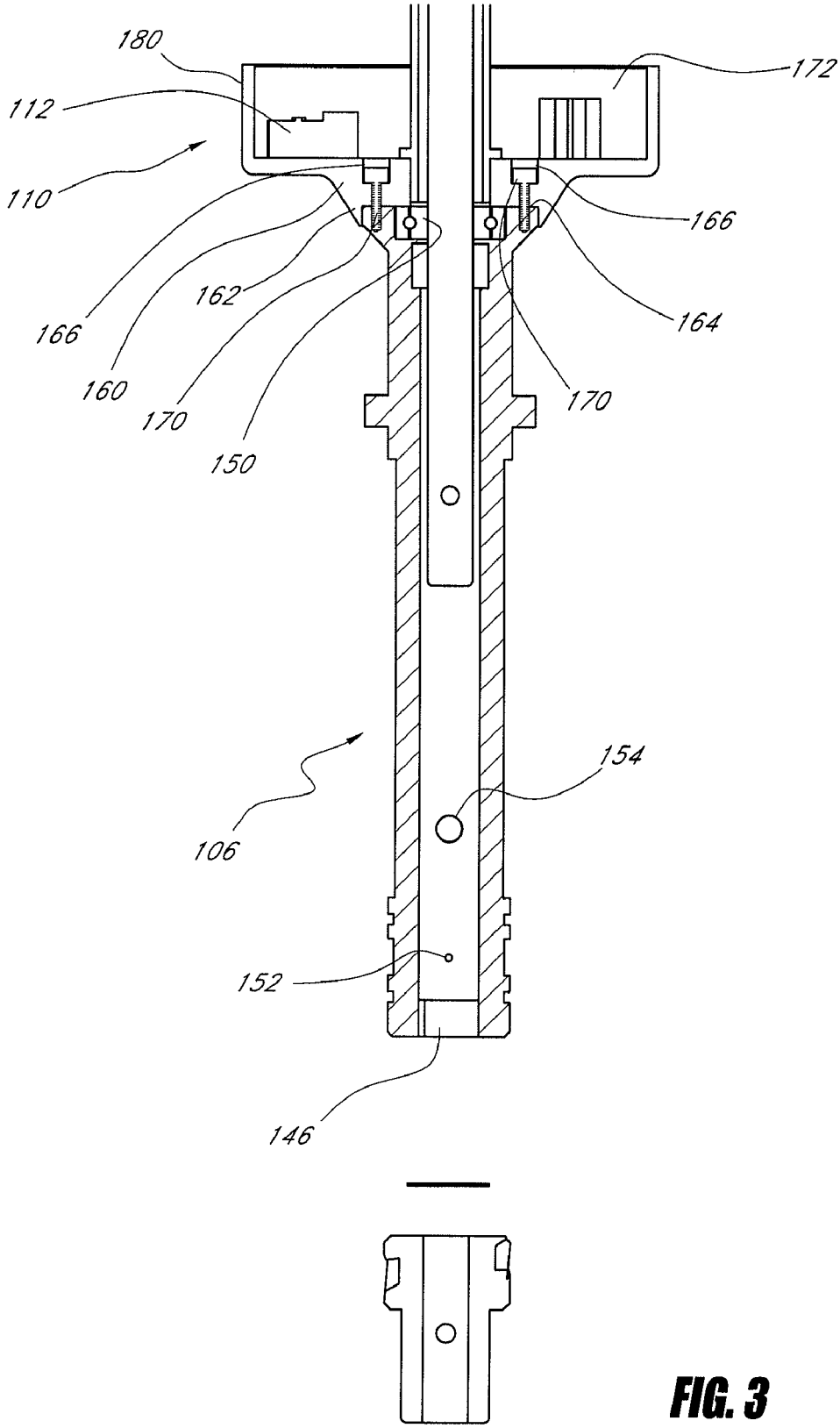
FIG. 3 is an enlarged sectional view of a portion of the distributor.
Figure 5:
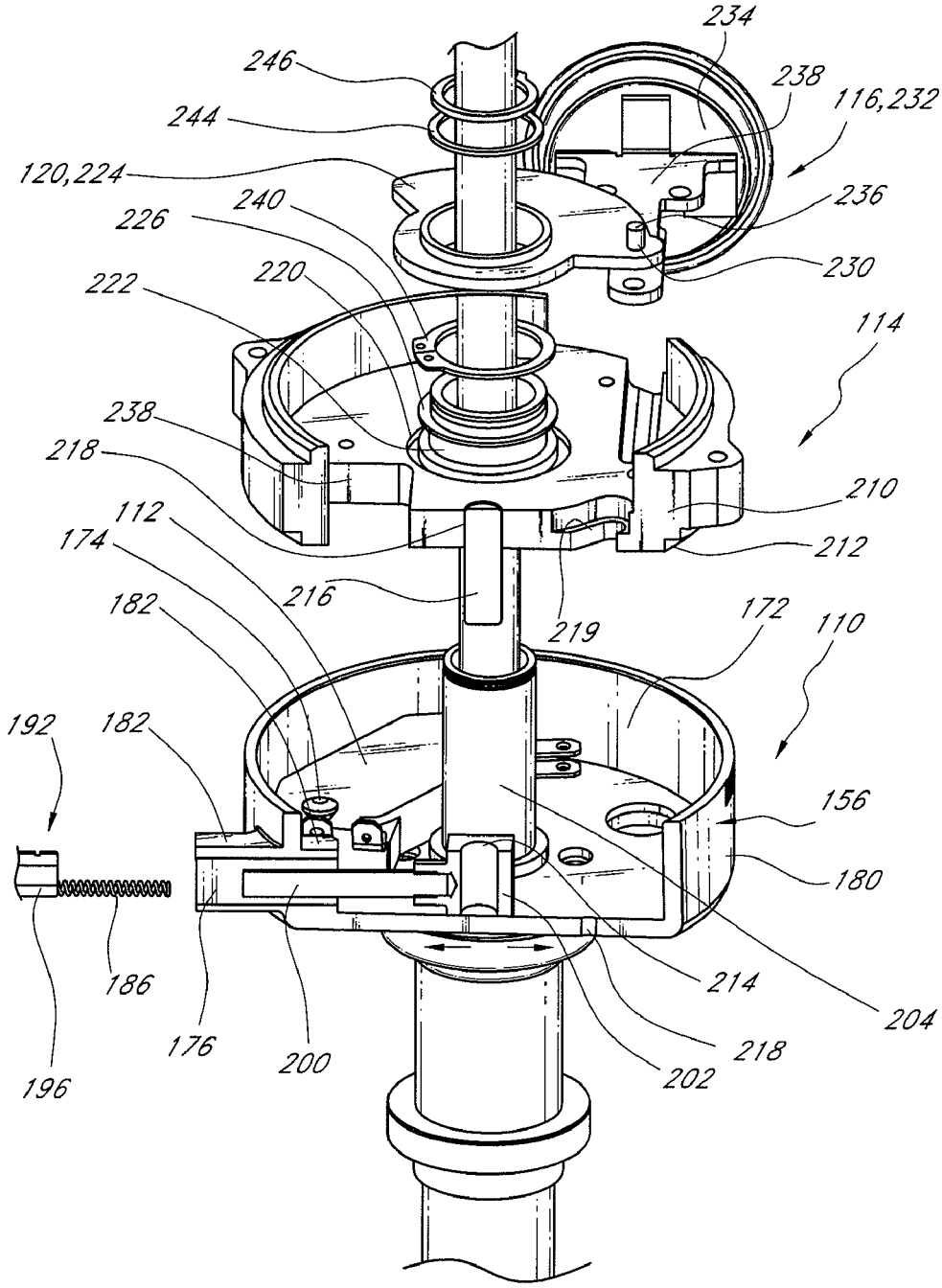
FIG. 5 is an enlarged partially sectioned perspective view of a portion of the distributor.

With reference to FIG. 5, the lower housing assembly 110 comprises a lower housing member 156. As shown in FIG. 3, the lower housing member 156 comprises a boss 160 on a lower portion of the lower housing member 156. The boss 160 includes an encircling flange 162 and a mounting face 164. The mounting face 164 receives an end portion of the shaft housing assembly 106. The shaft housing assembly 106 can be secured to the lower housing member 156 in any suitable manner. In the illustrated configuration, the lower housing member 156 comprises multiple holes 166 that receive threaded fasteners 170. The threaded fasteners 170 (e.g., socket head capscrews) thread into threaded bores formed in the upper portion of the shaft housing assembly 106. The assembly described directly above facilitates the usage of a single lower housing member 156 with differing shaft housing assemblies 106 depending upon the application.

The lower housing member 156 defines at least a portion of a recess 172. The recess 172 houses the ignition module 112. The ignition module 112 preferably is secured within the recess in any suitable position and in any suitable manner. In the illustrated configuration, as shown in FIG. 1, threaded members 174 (e.g., button head capscrews) secure the ignition module 112 within the lower housing member 156.

The illustrated lower housing member 156 also comprises an adjusting mechanism passage 176. The adjusting mechanism passage 176 extends through a sidewall 180 of the lower housing member 156. In the illustrated embodiment, the adjusting mechanism passage 176 also extends through an adjusting mechanism passage member 182. The member 182 can have any suitable configuration. In the illustrated configuration, the member 182 is generally cubic in shape with the passage 176 extending through the member 182. The member 182 can have a portion on each side of the sidewall 180. Other configurations are possible.

Figure 4:
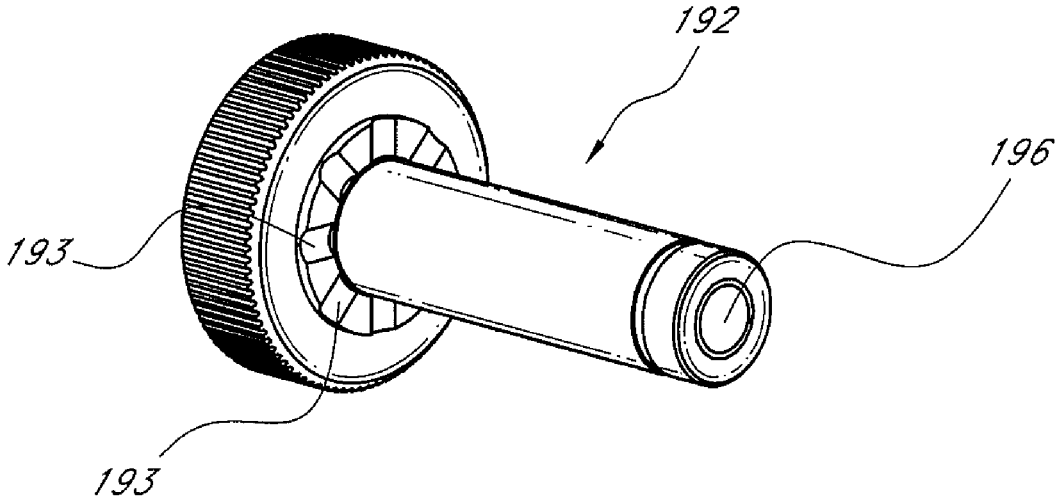
FIG. 4 is an enlarged perspective view of a thumbwheel.

The member 182 comprises a blind hole 184. The blind hole 184 receives a detent spring 186. A ball 190 presses against the detent spring 186 and the spring 186 presses the ball 190 outward against a back surface of a thumbwheel 192. With reference to FIG. 4, the back surface of the thumbwheel 192 preferably comprises a surface with alternating steps and recesses 193 into which the ball 190 can be biased. Thus, the thumbwheel 192 in combination with the ball 190 and the spring 186 provide force feedback to indicate how much the thumbwheel 192 is being turned. Moreover, the thumbwheel 192, ball 190, spring 186 combination helps improve the control a user has over the amount of adjustment made to timing. In some embodiments, the thumbwheel and force feedback arrangement enables advance or retard adjustments in ½ degree increments.

The thumbwheel 192 is secured in axial position relative to the passage 176 with a snap ring 194. Other configurations are possible. Preferably, the thumbwheel 192 comprises a threaded bore 196. An adjusting rod 200 threads into the threaded bore at one end and couples to a slider block 202 at the other end. Thus, as the thumbwheel 192 rotates relative to the passage 176, the adjusting rod 200 moves axially in and out of the thumbwheel 192. As the adjusting rod 200 moves axially in and out of the thumbwheel 192, the slider block 202 changes position.

To further support the distributor shaft 104, a center bushing 204 can be positioned within a center of the lower housing member 156. Thus, the distributor shaft 104 extends through a central hole formed in the lower housing member 156 and also extends within the center bushing 204 in the illustrated configuration.

A top plate 210, which forms a portion of the top plate assembly 114, overlies the lower housing member 156 such that the top plate 210 substantially closes off the recess 172 defined within the lower housing member 156. The top plate 210 can comprise a circumferential step or recess 212 that results in the top plate 210 having a portion that is received within the sidewall 180 of the lower housing member 156. The top plate 210 preferably is capable of rotation relative to the lower housing member 156.

The slider block 202 preferably comprises a generally vertical aperture 214. The aperture 214 receives a dowel pin 216. The dowel pin 216 extends upward from the slider block 202 into a hole 218 formed in the top plate 210. As the slider block 202 translates, the top plate 210 rotates. Thus, movement of the thumbwheel 192 causes movement of the adjusting rod 200, movement of the adjusting rod 200 causes movement of the dowel pin 216 and movement of the dowel pin 216 causes rotation of the top plate 210.

In some configurations, an opening 218 can be provided in the bottom of the lower housing member 156. The opening can receive a shoulder bolt or the like. The shoulder bolt can extended upward into a slotted opening 219 in the bottom of the top plate member 210. Thus, the shoulder bolt in combination with the slotted opening 219 can be used to limit the range of relative movement between the top plate member 210 and the lower housing member 156. Other configurations are possible, which can include inverting the components or provided a molded in component to limit the range of relative movement.

The top plate 210 comprises a central opening 220. The central opening receives a center bushing 222. The center bushing 222 preferably comprises a circumferential flange that rests against a recessed surface of the top plate 210. Other configurations are possible. The distributor shaft 104 extends through an interior of the center bushing 222 while a cam plate 224 and a cam plate washer 226 are mounted on an outside of the center bushing 222.

The cam plate 224 comprises a hole 230. The hole 230 connects with a vacuum advance mechanism 232. As is known, the vacuum advance mechanism comprises a spring-loaded diaphragm that fits inside a metal housing 234. The diaphragm is connected to a vacuum actuator arm 236, which connects with the hole 230. Accordingly, movement of the diaphragm within the metal housing 234 causes movement of the actuator arm 236, which causes corresponding movement of the cam plate 226. In the illustrated configuration, a bracket 238 carries the vacuum advance mechanism 232 and the bracket 238 can be secured to the top plate 210 with threaded fasteners or the like but any suitable manner can be used.

A sensor (not shown) can be mounted to the cam plate 226. The sensor detects movement of the reluctor 122. Movement of the cam plate 226 caused by the vacuum advance mechanism 232 can cause related movement of the sensor (not shown). In addition, movement of the top plate 210 relative to the lower housing member 156 also results in related movement of the sensor. Accordingly, because the sensor senses movement of the reluctor 122, the movement of the sensor caused by the vacuum advance mechanism 232 and the movement between the top plate and the lower housing member change the timing of movement of the reluctor 122 sensed by the sensor.

Wires from the sensor can extend through an enlarged opening 238 in the top plate 210. The wires, thus, can couple the sensor to the ignition module 112 while providing sufficient clearance to accommodate the relative movement between the top plate 210 and the lower housing member 156.

The cam plate 224 rests on a flange of the center bushing 222 and a snap ring 240 secures the cam plate 224 in axial position relative to the center bushing 222. An outer groove in the center bushing 222 receives the snap ring 240. In the illustrated configuration, a washer is positioned between the snap ring 240 and an upper surface of the cam plate 224. In addition, a center bushing shim 244 can be positioned on an upper surface of the center bushing 222.

Just above the center bushing 222, the reluctor 122 is mounted to the distributor shaft 104. The reluctor 122 can be held in position with a snap ring 246 or the like. The rotor assembly 124, which comprises a rotor 248 and a rotor contact 250, also is secured to the distributor shaft 104 in any suitable manner.

With reference to FIG. 1, markings 260 are shown on an upper portion of the lower housing member 156 and a lower portion of the top plate 210. These markings 260 can have any suitable form. In one configuration, the markings 260 on the lower housing member 156 define a graduated scale while the markings 260 on the top plate 210 define a single line. By observing movement of the line relative to the graduated scale, a user can visually observe the type (quality) and the amount (quantity) of movement they induce by rotation of the thumbwheel. Thus, controlled adjustments can be made and observed without the need for a timing light or mechanical tools. Moreover, the illustrated configuration enables timing adjustment without loosening an adjusting nut of a distributor, which is at the connection between the distributor and the associated engine.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. An adjustable advance distributor comprising a housing, the housing comprising a first portion and a second portion, an adjustment mechanism connecting the first portion and the second portion, the adjustment mechanism configured to impart relative movement between the first portion and the second portion, the first portion having a sensor connected thereto, the sensor adapted to detect movement of a reluctor positioned proximate the first portion and relative movement of the first portion causes movement of the sensor relative to the reluctor.

2. The distributor of claim 1, wherein the first portion comprises a top plate and the second portion comprises a lower housing member.

3. The distributor of claim 2, wherein the sensor is mounted on a cam plate.

4. The distributor of claim 3, wherein the cam plate is moveable relative to the top plate.

5. The distributor of claim 4, wherein the cam plate is connected to an actuator of a vacuum advance module and the vacuum advance module is connected to the top plate such that movement of the top plate causes movement of the vacuum advance module while movement of the actuator of the vacuum advance module causes movement of the cam plate relative to the top plate.

6. The distributor of claim 2, wherein an outer surface of the top plate and an outer surface of the lower housing member comprise cooperating markings that show relative movement between the top plate and the lower housing member.

7. The distributor of claim 1, wherein the adjustment mechanism comprises a thumbwheel that is connected to a slider block and wherein the thumbwheel is connected to one of the first portion and the second portion.

8. The distributor of claim 7, wherein the thumbwheel and the slider block are connected with a mechanism that changes rotary motion of the thumbwheel to translational motion of the slider block.

9. The distributor of claim 7 further comprising a shaft extending between the thumbwheel and the slider block.

10. The distributor of claim 9, wherein the shaft is threadedly connected to at least one of the thumbwheel and the slider block such that rotation of the thumbwheel causes translational movement of the slider block.

11. The distributor of claim 9, wherein the shaft and the thumbwheel are coupled with a threaded connection such that rotation of the thumbwheel results in axial movement of the shaft and axial movement of the shaft results in movement of the slider block.

12. The distributor of claim 7 further comprising a force feedback mechanism connected to the thumbwheel.

13. The distributor of claim 12, wherein the force feedback mechanism comprises a ball and a spring.

14. The distributor of claim 13, wherein the thumbwheel comprises a back surface with at least one recess, the ball being urged into the recess by the spring when the ball is aligned with the recess.

15. The distributor of claim 1, wherein the adjustment mechanism comprises a thumbwheel, the thumbwheel being connected to the first portion, a shaft being coupled to the thumbwheel at a first end, the shaft being coupled to a slide block at a second end, the shaft and the thumbwheel being coupled with a threaded connection such that rotation of the thumbwheel causes axial movement of the shaft, a second end of the shaft being coupled to a slide block such that axial movement of the shaft causes movement of the slide block, a pin extending from the second portion and being connected to the slide block such that movement of the slide block causes movement of the second portion relative to the first portion.

16. The distributor of claim 15 further comprising an adjusting mechanism passage extending through a wall of the first portion, the passage receiving at least a portion of the shaft.

17. The distributor of claim 16 further comprising an adjusting mechanism passage member through which the adjusting mechanism passage extends.

18. A method of constructing a distributor, the method comprising providing a distributor housing, the distributor housing comprising a first outer housing portion and a second outer housing portion, the first portion being adjustable relative to the second portion, selecting a gear from a plurality of gears based upon information regarding what type of engine the distributor will be joined to, selecting a lower shaft housing member based upon information regarding what type of engine the distributor will be joined to, coupling the lower shaft housing member to the first outer housing portion and joining the gear to a distributor shaft.

* * * * *